US005189960A

United States Patent [19]

Valentini et al.

[11] Patent Number: 5,189,960

[45] Date of Patent: Mar. 2, 1993

[54] APPARATUS AND METHOD FOR CONTROLLING TEMPERATURE OF PRINTING PLATE ON CYLINDER IN ROTARY PRESS

[76] Inventors: Fredric Valentini, 718 N. Lombard, Oak Park, Ill. 60302; David W. Moore, 1543 Walnut, Western Springs, Ill. 60558

[21] Appl. No.: 795,945

[22] Filed: Nov. 18, 1991

[51] Int. Cl.[5] ..... B41F 23/04

[52] U.S. Cl. ..... 101/487; 101/349; 101/216; 165/89

[58] Field of Search ..... 101/487, 424.1, 349, 101/350, 216; 165/89, 36, 30; 236/12.13; 34/13, 62

[56] References Cited

U.S. PATENT DOCUMENTS

| | | | |
|---|---|---|---|
| 1,681,603 | 7/1926 | Wilhelm | 101/487 |
| 2,971,460 | 2/1961 | Shindle | 101/487 |
| 3,741,115 | 6/1973 | Keller | 101/350 |
| 4,638,851 | 1/1987 | Makihara et al. | 165/32 |
| 4,693,179 | 9/1987 | Watts | 101/119 |
| 4,734,229 | 3/1988 | Johnson et al. | 165/89 |
| 4,877,331 | 10/1989 | Schrors et al. | 374/153 |
| 4,879,951 | 11/1989 | Yoshida et al. | 101/366 |
| 4,984,628 | 1/1991 | Uchida et al. | 165/30 |
| 5,074,213 | 12/1991 | Kurosawa | 101/487 |

*Primary Examiner*—Edgar S. Burr
*Assistant Examiner*—Lynn D. Hendrickson
*Attorney, Agent, or Firm*—Mark I. Feldman

[57] ABSTRACT

In a rotary press, temperature of a printing plate is sensed by an infrared temperature sensor mounted in close proximity to a cylinder carrying the printing plate. Sensor output is used to control a closed loop of a water circulating system which includes one or more water-carrying rollers in an ink train. A water cooler and a water heater are provided in the closed loop and are controlled in response to the sensor output to maintain the printing plate at a temperature which allows proper inking thereof.

8 Claims, 1 Drawing Sheet

APPARATUS AND METHOD FOR CONTROLLING TEMPERATURE OF PRINTING PLATE ON CYLINDER IN ROTARY PRESS

BACKGROUND OF THE INVENTION

1. Field of the Invention

The present invention pertains to rotary printing presses and, more particularly, to the control of the temperature of the plate on a cylinder in such presses.

2. Description of the Related Art

The temperature of the plate on a cylinder of a rotary printing press is important in maintaining printing quality as the ability to achieve proper inking of the plate is related to temperature. If the plate temperature is too high, the ink viscosity drops. Thus, the ink breaks down and tends to adhere to the nonimage bearing areas of the plate. Improper inking may also occur when the plate temperature is too low.

U.S. Pat. No. 2,971,460 issued to Shindle in 1961 and discloses a system for controlling ink roller temperature in a printing press by means of water circulating through the hollow interior of the rollers. This system is primarily concerned with heating of the rollers with heat extracted from web cooling rollers. When cooling of the inking rollers is necessary, the system relies on the use of cold water from an external source with the subsequent discharge of the water to a drain. However, such an open circulation system is wasteful of water.

Temperature control in the Shindle system is by way of thermostatic valves which are responsive to the water temperature which is, effectively, only an indirect measurement of the inking roller temperature.

Modern rotary presses and the inks used therewith are such that cooling, rather than heating, of the inking train and printing plate has primary importance. It is, accordingly, a primary object of the present invention to provide a system for effecting such cooling in an efficient, water-conserving manner.

In the printing process, the critical temperature for proper inking is that of the printing plate itself. It is also a principal object of the present invention to provide a temperature control system which is directly responsive to the plate temperature.

A further object of the invention is the provision of such a temperature control system which is capable of either cooling or heating the printing plate.

SUMMARY OF THE INVENTION

The above and other objects of the invention will become apparent hereinafter and are achieved by the provision of a plate temperature control system for a rotary printing press. This system includes a closed loop water circulating system including one or more, preferably three, hollow, water-carrying rollers in the ink train of the press, a water heater, a water cooler, a controlled mixing valve, and a circulating pump; an electrical control system for the water heater, water cooler, mixing valve and pump; and an infrared temperature sensor being mounted in close proximity to the plate cylinder of the press to detect its temperature. The sensor also provides input to the control system.

For a more complete understanding of the invention and the objects thereof, reference should be made to the accompanying drawing and the following detailed description wherein a preferred embodiment of the invention is illustrated and described.

DESCRIPTION OF THE PREFERRED EMBODIMENT

Figure 1:
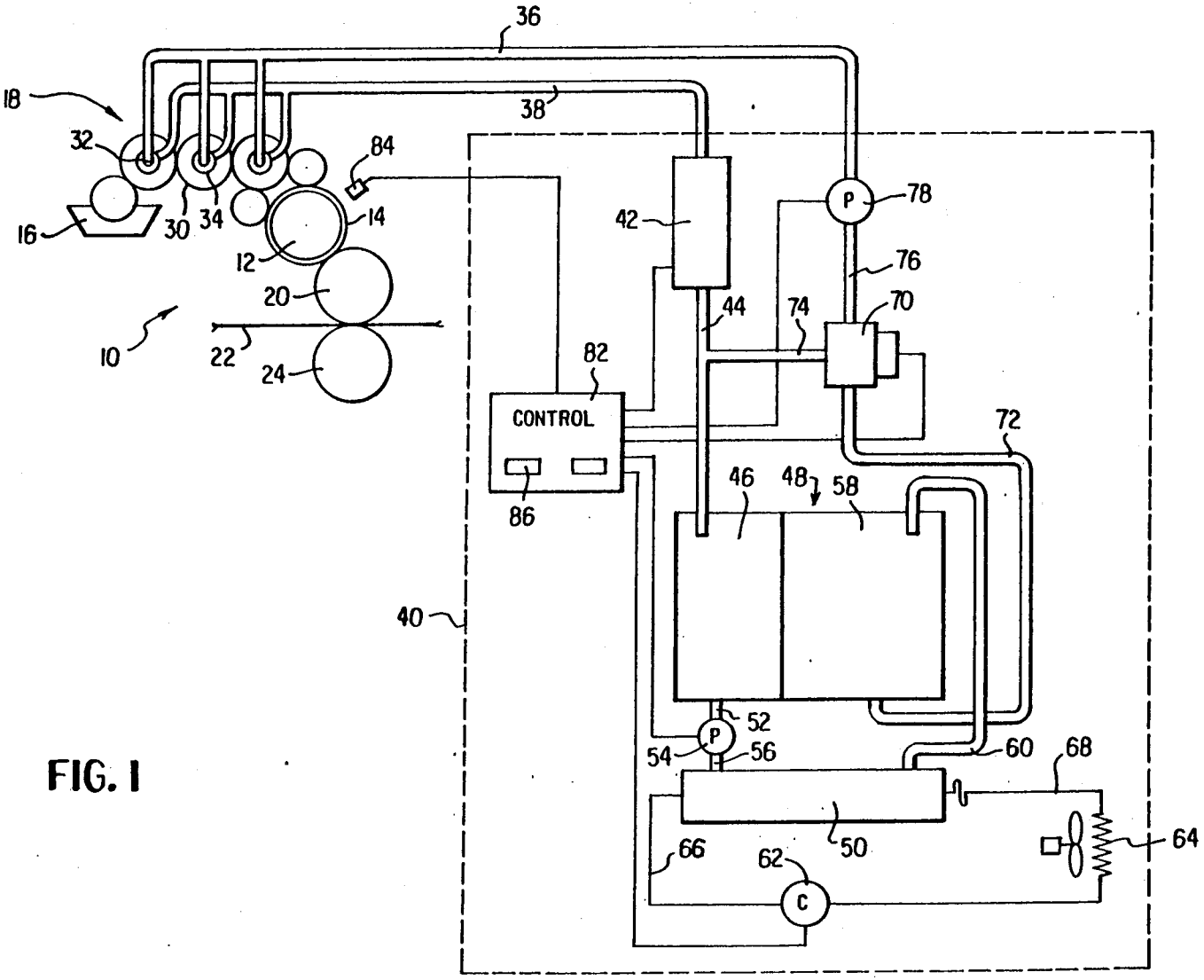
FIG. 1, the sole FIGURE, is a schematic showing of a rotary printing press and the plate temperature control system of the present invention.

Generally, a rotary offset printing press 10, with the exception of the temperature control system of the present invention, has a conventional design and construction. Such a press 10 includes a plate cylinder 12 which carries, on the circumferential face thereof, a printing plate 14. Ink is furnished to the plate 14 from a fountain 16 by way of an ink train 18 consisting of a plurality of inking rollers 30. As is well known, the plate 14 is etched so as to be ink receptive only in those areas which are to be printed. From the plate 14, the ink is transferred to a blanket cylinder 20 and then to a sheet or web 22 of paper or the like brought into contact therewith by an impression cylinder 24.

As was discussed above, proper inking of the plate 14, so as to provide quality printing, is dependent, in part, on the ink temperature as it is applied to the plate 14. Excessive temperature causes a lowering of ink viscosity and a break down of the ink with smearing of the ink onto the nonprinting regions of the plate 14. Improper inking of the plate 14 may also occur when the ink temperature is too low, as may be the case during start-up or after the press 10 has been shutdown for a long period of time.

In accordance with the present invention, a closed loop water circulating system responsive to the temperature of the printing plate 14 is provided to maintain the desired plate temperature and, accordingly, the temperature of the ink applied thereto. In this system, one or more, preferably three, of the rollers 30 of the ink train 18 are hollow and are provided with rotary water inlet and outlet connections 32 and 34, respectively, whereby water is circulated within the rollers 30 in heat exchange therewith. The details of such rollers 30 and rotary connections 32 and 34 are well known and need not be further described herein.

Supply and return conduits 36 and 38, respectively, connect the rollers 30 to a water circulating and cooling/heating unit 40. Water entering the unit 40 from conduit 38 flows first through a water heater 42 which is, preferably, a flow-through electric heater, to a pipe 44 leading to an inlet chamber 46 of a dual chamber reservoir 48. A water chiller 50 has its inlet connected to the inlet chamber 46 by a pipe 52, a first circulating pump 54, and a pipe 56. The water chiller 50 has its outlet connected to an outlet chamber 58 of the reservoir 48 by a pipe 60. The chiller 50 is connected to a refrigeration system including a compressor 62 and a condenser 64 via refrigerant lines 66 and 68, respectively. A controllable mixing valve 70 has its first inlet connected by piping 72 to the outlet chamber 58 of the reservoir 48 and its second inlet connected to a pipe 74 which branches from the pipe 44. The outlet of the valve 70 is connected by piping 76 to a second circulating pump 78 which, in turn, has its outlet connected to the supply conduit 36.

The cooling/heating unit 40 is capable of circulating either cooled or heated water through the rollers 30 of the ink train 18 in order to maintain the ink at the desired temperature for proper inking of the plate 14.

Operation of the unit 40 is regulated by an electrical control unit 82 in accordance with the temperature of the printing plate 14. A plate temperature sensor 84 provides an input to the control unit 82. In the preferred embodiment, this sensor 84 is an infrared sensor mounted in close proximity to the periphery of the printing plate 14 of the cylinder 12, preferably midway between the ends thereof. It will be appreciated, however, that other types of sensors for detecting the temperature of the printing plate 14 may be employed. The control unit 82 is provided with an appropriate input device 86 by which the desired plate temperature is supplied manually by an operator of the printing press 10.

The operation of the invention will now be described. When the press 10 is initially started, the cylinders 12 and the rollers 30 may be such that the plate temperature is lower than desired. Under these circumstances, the control unit 82 activates the second circulating pump 78 and the water heater 42. The unit 82 also energizes the mixing valve 70 so that water is circulated through the heater 42, the pipe 44, the branch pipe 74, and the pipe 76 to the second circulating pump 78 to supply heated water to the conduit 36 for circulation through the hollow ink rollers 30.

As the plate temperature rises due both to heat supplied by the unit 40 and also due to frictionally generated heat occurring during operation of the press 10, cooling of the printing plate 14 becomes necessary to maintain the desired inking temperature. In the cooling mode of the unit 40, the heater 42 is turned off while the chiller 50 is activated to maintain a supply of cooled water in the outlet chamber 58. The mixing valve 70, under control of the control unit 82, regulates the temperature of the water supplied to the inking rollers 30 through the conduit 36 by proportioning the amount of cooled water from the chamber 58 with the amount of warm water returning from the rollers 30 through the conduit 38 and the branch pipe 74. By way of example, if a plate temperature of 60° F. is desired, the temperature of the water supplied is about 48° F. as will be apparent to those skilled in the art, the temperatures are dependent on several factors, including the speed of the operating press 10 and the amount of ink coverage.

While, in the illustrated embodiment, the cooling-/heating unit 40 is an integrated unit, it may be preferable to have the reservoir 48 and the water chiller 50 located separately from the remainder of the unit 40. The space available for installation, as well as other factors, determine the particular configuration.

As these and other changes may be made in the described embodiment of the invention without departing from the spirit thereof, reference should be had to the appended claims in determining the true scope of the invention.

What is claimed is:

1. A temperature control system for a printing plate of a rotary press of a type having a cylinder, said printing plate being carried on the cylinder, and an ink train including a plurality of ink rollers, at least one of which rollers is hollow and equipped with connections for circulating water in a heat exchange relationship therethrough, said system comprising:

a water circulating unit including a two-chambered water reservoir, two circulating pumps, a water chiller, a water heater and a controllable mixing valve, said circulating unit being connected to the hollow roller to provide a closed loop water circulating path;

temperature sensing means for detecting a temperature of the printing plate and also for generating a signal corresponding to a detected plate temperature; and means, responsive to the signal, for controlling the circulating unit so as to regulate a temperature of the water circulating through the closed loop path in accordance with the detected plate temperature.

2. The temperature control system of claim 1 wherein said temperature sensing means comprises an infrared temperature sensor mounted in close proximity to the cylinder.

3. A temperature control system for a printing plate of a rotary press of a type having a cylinder, said printing plate being carried on the cylinder, and an ink train including a plurality of ink rollers, at least one of which rollers is hollow and equipped with connections for circulating water in a heat exchange relationship therethrough, said system comprising:

a water circulating unit including a circulating pump, a water chiller, and a controllable mixing valve, said circulating unit being connected to the hollow roller to provide a closed loop water circulating path;

temperature sensing means for detecting a temperature of the printing plate and also for generating a signal corresponding to a detected plate temperature; and means, responsive to the signal, for controlling the circulating unit so as to regulate a temperature of the water circulating through the closed loop path in accordance with the detected plate temperature;

wherein said temperature sensing means comprises an infrared temperature sensor mounted in close proximity to the cylinder;

wherein the circulating unit further includes a water heater; and wherein the circulating unit further includes a reservoir having a first chamber receiving water returned from the roller and also having a second chamber, said water chiller being connected between the first chamber and the second chamber, said mixing valve having a first inlet connected to the second chamber for receiving cooled water therefrom and also having a second inlet for receiving water returned from the roller, said mixing valve being operable to proportion water flow through the first inlet and the second inlet in accordance with a desired water temperature.

4. A temperature control system for a printing plate of a rotary press of a type having a cylinder, said printing plate being carried on the cylinder, and an ink train including a plurality of ink rollers, at least one of which rollers is hollow and equipped with connections for circulating water in a heat exchange relationship therethrough, said system comprising:

a water circulating unit including a circulating pump, a water chiller, and a controllable mixing valve, said circulating unit being connected to the hollow roller to provide a closed loop water circulating path;

temperature sensing means for detecting a temperature of the printing plate and also for generating a signal corresponding to a detected plate temperature; and means, responsive to the signal, for controlling the circulating unit so as to regulate a temperature of the water circulating through the closed loop path in accordance with the detected plate temperature;

wherein the circulating unit further includes a water heater; and wherein the circulating unit further includes a reservoir having a first chamber receiving water returned from the roller and also having a second chamber, said water chiller being connected between the first chamber and the second chamber, said mixing valve having a first inlet connected to the second chamber for receiving cooled water therefrom and also having as second inlet for receiving water returned from the roller, said mixing valve being operable to proportion water flow through the first inlet and the second inlet in accordance with a desired water temperature.

5. A temperature control system for a printing plate of a rotary press of a type having a cylinder, said printing plate being carried on the cylinder, and an ink train including a plurality of ink rollers, at least one of which rollers is hollow and equipped with connections for circulating water in a heat exchange relationship therethrough, said system comprising:

a water circulating unit including a circulating pump, a water chiller, and a controllable mixing valve, said circulating unit being connected to the hollow roller to provide a closed loop water circulating path;

temperature sensing means for detecting a temperature of the printing plate and also for generating a signal corresponding to a detected plate temperature; and means, responsive to the signal, for controlling the circulating unit so as to regulate a temperature of the water circulating through the closed loop path in accordance with the detected plate temperature;

wherein the circulating unit further includes a reservoir having a first chamber receiving water returned from the roller and also having a second chamber, said water chiller being connected between the first chamber and the second chamber, said mixing valve having a first inlet connected to the second chamber for receiving cooled water therefrom and also having a second inlet for receiving water returned from the roller, said mixing valve being operable to proportion water flow through the first inlet and the second inlet in accordance with a desired water temperature.

6. A method of controlling a temperature of a printing plate of a rotary press of a type having a cylinder, said printing plate being carried on the cylinder, said rotary press having an ink train with a plurality of ink rollers, at least one of which is hollow and equipped with connections for circulating water in a heat exchange relationship therethrough, said method comprising the steps of:

pumping circulating water in a closed loop path from a two-chambered water reservoir to a controllable mixing valve through at least one hollow roller and back to the water reservoir;

measuring the temperature of the printing plate via a sensor;

generating from the sensor a signal corresponding to a measured plate temperature; and controlling temperature of the circulating water via a water heater and a water chiller in response to the signal corresponding to the measured plate temperature.

7. A temperature control system for a printing plate of a rotary press of a type having a cylinder, said printing plate being carried on the cylinder, and an ink train including a plurality of ink rollers, at least one of which rollers is hollow and equipped with connections for circulating water in a heat exchange relationship therethrough, said system comprising:

a water circulating unit including a two-chambered water reservoir, two circulating pumps, a water chiller, a water heater, and a controllable mixing valve, said circulating unit being connected to the hollow roller to provide a closed loop water circulating path;

temperature sensing means for detecting a temperature at a selected point of the rotary press and also for generating a signal corresponding to a detected temperature at the selected point; and means, responsive to the signal, for controlling the circulating unit so as to regulate a temperature of the water circulating through the closed loop path in accordance with the detected temperature at the selected point.

8. A method of controlling a temperature of a printing plate of a rotary press of a type having a cylinder, said printing plate being carried on the cylinder, said rotary press having an ink train with a plurality of ink rollers, at least one of which is hollow and equipped with connections for circulating water in a heat exchange relationship therethrough, said method comprising the steps of:

pumping circulating water in a closed loop path from a two-chambered water reservoir to a controllable mixing valve through at least one hollow roller and back to the water reservoir;

measuring the temperature at a selected point of the rotary press via a sensor;

generating from the sensor a signal corresponding to a measured temperature at the selected point; and controlling temperature of the circulating water via a water heater and a water chiller in response to the signal corresponding to the measured temperature at the selected point.

* * * * *